US011819111B1

(12) United States Patent
Antoniazzi et al.

(10) Patent No.: US 11,819,111 B1
(45) Date of Patent: Nov. 21, 2023

(54) CAULK TOOL BELT

(71) Applicants: Andre Antoniazzi, Vaughn (CA); Fabio Colletta, Vaughn (CA)

(72) Inventors: Andre Antoniazzi, Vaughn (CA); Fabio Colletta, Vaughn (CA)

( * ) Notice: Subject to any disclaimer, the term of this patent is extended or adjusted under 35 U.S.C. 154(b) by 375 days.

(21) Appl. No.: 17/241,690

(22) Filed: Apr. 27, 2021

(51) Int. Cl.
*A45F 5/02* (2006.01)
*A45F 3/14* (2006.01)
*A45C 11/00* (2006.01)

(52) U.S. Cl.
CPC ..... *A45F 3/14* (2013.01); *A45F 2003/144* (2013.01); *A45F 2200/0566* (2013.01); *A45F 2200/0575* (2013.01)

(58) Field of Classification Search
CPC ..... A45F 3/14; A45F 2003/144; A45F 2200/0566; A45F 2200/0575
See application file for complete search history.

(56) References Cited

U.S. PATENT DOCUMENTS 1,290,827 A * 1/1919 Yergason ..... F42B 39/02 224/648
2,566,750 A * 9/1951 Safir ..... A41D 27/08 2/311
2,710,639 A * 6/1955 Farls ..... A45F 3/00 383/76
3,529,307 A * 9/1970 Belson ..... A41D 13/0012 2/94
3,624,686 A * 11/1971 Beals ..... G09B 19/0023 2/48
4,106,121 A * 8/1978 Belson ..... A41D 13/0012 2/102
4,300,708 A * 11/1981 Pattermann ..... A45F 5/02 224/232
4,369,526 A * 1/1983 Clutts ..... A41D 13/04 2/70
4,819,846 A * 4/1989 Hannemann ..... A45F 5/00 224/241
4,830,247 A * 5/1989 Banks ..... B25H 3/006 224/678
4,848,624 A * 7/1989 Clem ..... A45C 1/04 224/267
4,953,765 A * 9/1990 Little ..... A45F 5/00 383/902

(Continued)

*Primary Examiner* — Robert H Muromoto, Jr.
(74) *Attorney, Agent, or Firm* — SANCHELIMA & ASSOCIATES, P.A.; Christian Sanchelima; Jesus Sanchelima

(57) ABSTRACT

A caulk tool belt including a belt assembly, pocket assemblies, and a heated pocket assembly is disclosed. These assemblies in conjunction with one another provide a convenient solution to storing an assortment of tools related to caulking as well as the caulking tubes themselves. The belt assembly wraps around a user and serves as a mounting point for the pocket assemblies and the heated pocket assembly. The caulking tubes are stored in a large front heated pocket. The heated pocket includes a heating element internally mounted between two layers of said heated pocket. During cold winter months the heating of the caulking tubes is integral to keeping the caulk malleable so that it may be more easily spread over surfaces and gaps. The heated pocket is powered by a rechargeable battery also located in its own belt mounted pocket.

10 Claims, 4 Drawing Sheets

(56) References Cited

U.S. PATENT DOCUMENTS 4,957,231 A * 9/1990 Kalisher ..... A01K 97/06 224/268
4,974,752 A * 12/1990 Sirek ..... B05C 17/00533 222/391
4,986,459 A * 1/1991 Yarbrough, Jr. ..... A45F 5/14 224/195
D316,485 S * 4/1991 Seber ..... 224/904
5,004,136 A * 4/1991 Leath ..... A47L 13/51 224/904
5,201,448 A * 4/1993 Schue ..... B25H 3/00 224/660
5,211,321 A * 5/1993 Rodriguez ..... A41D 13/0012 224/604
5,240,156 A * 8/1993 Sicotte ..... A45F 5/02 224/583
5,247,707 A * 9/1993 Parker ..... A41D 13/0012 2/108
5,302,302 A * 4/1994 Shelley ..... A45F 5/02 224/679
D348,565 S * 7/1994 Cummins ..... 224/663
5,341,975 A * 8/1994 Marinescu ..... A45F 5/02 224/684
5,349,706 A * 9/1994 Keer ..... A41D 13/0012 224/582
5,385,281 A * 1/1995 Byrd ..... B44D 3/123 224/663
5,409,153 A * 4/1995 Ristich ..... A45C 1/04 D3/238
5,413,262 A * 5/1995 Dewire ..... A41F 9/002 224/675
5,427,239 A * 6/1995 Hunt ..... B25H 3/00 190/125
5,441,185 A * 8/1995 Dragos ..... A45F 5/02 224/904
D367,356 S * 2/1996 Brown, Jr. ..... D3/226
5,488,799 A * 2/1996 Hauschild ..... A01K 97/08 224/660
5,489,051 A * 2/1996 Robinson ..... B44D 3/121 220/570
5,501,379 A * 3/1996 Munoz ..... B25H 3/00 224/684
5,505,356 A * 4/1996 Noriega ..... A41D 13/0012 2/338
5,568,887 A * 10/1996 Gollihue ..... B25H 3/00 224/904
5,568,889 A * 10/1996 Holloway, Jr. ..... B25H 3/00 224/904
5,609,283 A * 3/1997 Harrison, Jr. ..... A45F 5/02 224/678
5,615,805 A * 4/1997 Yoncak ..... B67D 7/80 219/535
5,664,712 A * 9/1997 Smrt ..... A45F 5/02 224/904
5,683,022 A * 11/1997 Evans ..... A45F 5/02 224/672
5,693,006 A * 12/1997 Slautterback ..... A61F 5/028 224/675
5,695,104 A * 12/1997 Darling ..... B25H 3/00 224/684
D393,948 S * 5/1998 Cowlen ..... D3/320
5,893,370 A * 4/1999 Perez ..... A41D 13/0012 2/94
5,893,502 A * 4/1999 Redzisz ..... F41C 33/06 224/586
5,894,976 A * 4/1999 Harper ..... F41C 33/046 224/660
D409,381 S * 5/1999 Cleveland ..... D3/228
D411,659 S * 6/1999 Karton ..... D3/226
5,934,530 A * 8/1999 Antczak ..... A63B 55/408 224/678
5,941,438 A * 8/1999 Price ..... A41F 9/002 224/660
5,943,696 A * 8/1999 Walker ..... B44D 3/14 224/904
D415,891 S * 11/1999 Renna ..... D3/221
5,981,909 A * 11/1999 Freeman ..... B25H 3/006 219/386
6,073,823 A * 6/2000 Gordon ..... A45F 5/02 224/684
D433,228 S * 11/2000 Wentling, Jr. ..... D3/226
6,213,365 B1 * 4/2001 Stocke ..... A41D 13/0012 224/684
6,260,202 B1 * 7/2001 Villalobos ..... G21F 3/02 224/648
D448,556 S * 10/2001 Snider ..... D3/228
6,311,336 B1 * 11/2001 Gootrad ..... A45C 11/22 224/257
6,325,261 B1 * 12/2001 Webber ..... B05C 17/01 224/904
6,357,639 B1 * 3/2002 Williams ..... A01K 97/10 224/245
6,398,092 B1 * 6/2002 Ansley ..... A61F 5/028 224/582
6,405,911 B1 * 6/2002 Howard ..... H04M 1/05 224/684
6,446,852 B1 * 9/2002 Sorensen ..... B25H 3/00 224/904
6,474,519 B1 * 11/2002 Cleveland ..... A45F 5/021 224/904
6,491,191 B1 * 12/2002 Cleveland ..... A45F 5/00 224/904
6,508,390 B1 * 1/2003 Karpati ..... A45F 5/021 224/678
6,568,575 B1 * 5/2003 Bartholomew ..... A45F 3/14 224/655
6,698,601 B1 * 3/2004 Nez ..... F16M 13/02 224/904
6,698,632 B1 * 3/2004 Turner, Jr. ..... B25H 3/00 224/904
6,712,251 B2 * 3/2004 Godshaw ..... A45F 3/14 224/675
6,713,727 B1 * 3/2004 Johnson ..... B05C 17/00523 219/386
6,726,075 B1 * 4/2004 Patel ..... A45F 3/14 224/582
6,737,610 B1 * 5/2004 Horn ..... H05B 1/0272 219/549
6,913,176 B1 * 7/2005 Buscemi ..... A45F 5/00 224/665
7,007,832 B1 * 3/2006 Payne ..... A45F 5/022 224/660
7,124,921 B1 * 10/2006 Hubbell ..... A45F 3/16 224/652
7,552,904 B2 * 6/2009 Zehnder ..... A45C 9/00 248/682
7,699,197 B2 * 4/2010 Panosian ..... A45F 5/02 224/665
8,128,445 B2 * 3/2012 Cunningham ..... B63C 9/32 441/108
8,490,216 B2 * 7/2013 Haynes ..... A41D 1/04 2/102
8,793,815 B1 * 8/2014 Kelley-Mozsy ... A41D 13/0058 2/247
8,925,115 B1 * 1/2015 Hanna ..... A61F 17/00 2/2.5
9,289,051 B1 * 3/2016 Capps ..... A45F 3/04
9,402,458 B2 * 8/2016 Kooyers ..... A45F 5/021
D771,937 S * 11/2016 Kinskey ..... D3/228
D771,939 S * 11/2016 Kinskey ..... D3/228
D779,194 S * 2/2017 Kinskey ..... D3/228
D779,195 S * 2/2017 Kinskey ..... D3/228
D779,196 S * 2/2017 Kinskey ..... D3/228
9,820,556 B2 * 11/2017 Adams ..... A45F 3/10
D820,585 S * 6/2018 O'Brien ..... D3/224
10,051,948 B2 * 8/2018 Carver ..... A45F 5/021
10,154,676 B1 * 12/2018 Ready ..... B05C 17/00523
10,278,482 B1 * 5/2019 McElveen ..... A45F 5/021
10,299,546 B2 * 5/2019 Teal ..... A44C 5/003

(56) References Cited

U.S. PATENT DOCUMENTS

| | | | | |
|---|---|---|---|---|
| 10,342,272 | B2 * | 7/2019 | Hendrick | A41D 13/02 |
| 10,939,709 | B2 * | 3/2021 | Haynes | A41D 1/04 |
| 10,946,248 | B1 * | 3/2021 | Rullo | A63B 27/00 |
| 2010/0084431 | A1 * | 4/2010 | Miller | B05C 17/00546 222/326 |
| 2010/0230440 | A1 * | 9/2010 | Cardea | B05C 17/00523 222/146.5 |
| 2010/0313329 | A1 * | 12/2010 | Haynes | A41D 1/04 2/102 |
| 2013/0305429 | A1 * | 11/2013 | Haynes | A41D 13/0012 2/102 |
| 2015/0089708 | A1 * | 4/2015 | Trevino | A41D 13/0012 2/69 |
| 2016/0368017 | A1 * | 12/2016 | Dlugosz | F24V 30/00 |
| 2020/0029678 | A1 * | 1/2020 | Griffin | A45F 5/021 |
| 2020/0288830 | A1 * | 9/2020 | Thompson | A45C 11/182 |
| 2022/0022632 | A1 * | 1/2022 | Bottros | A47L 1/06 |

* cited by examiner

CAULK TOOL BELT

II. BACKGROUND OF THE INVENTION

1. Field of the Invention

The present invention relates to a caulk tool belt and, more particularly, to a caulk tool belt that includes an integrated heating system.

2. Description of the Related Art

Several designs for a caulk tool belt have been designed in the past. None of them, however, include an integrated heating system for caulk.

Applicant believes that a related reference corresponds to U.S. Pat. No. 6,073,823 for a multi-purpose utility belt having multiple pockets, where each pocket is designed to retain a select tool such as a paint brush, a caulking gun and similar items. Applicant believes another related reference corresponds to U.S. Pat. No. 4,830,247 for a belt suspended holster for a caulking gun. None of these references, however, teach of a caulk tool belt with multiple tiered pockets and a heated pocket assembly for the storage of caulk.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a tool belt for caulking.

It is another object of this invention to provide an adjustable belt to serve as a mounting point for several multi-tiered pockets.

It is still another object of the present invention to provide a large rectangular front pocket that includes an integrated heating element.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE EMBODIMENTS OF THE INVENTION

Figure 1:
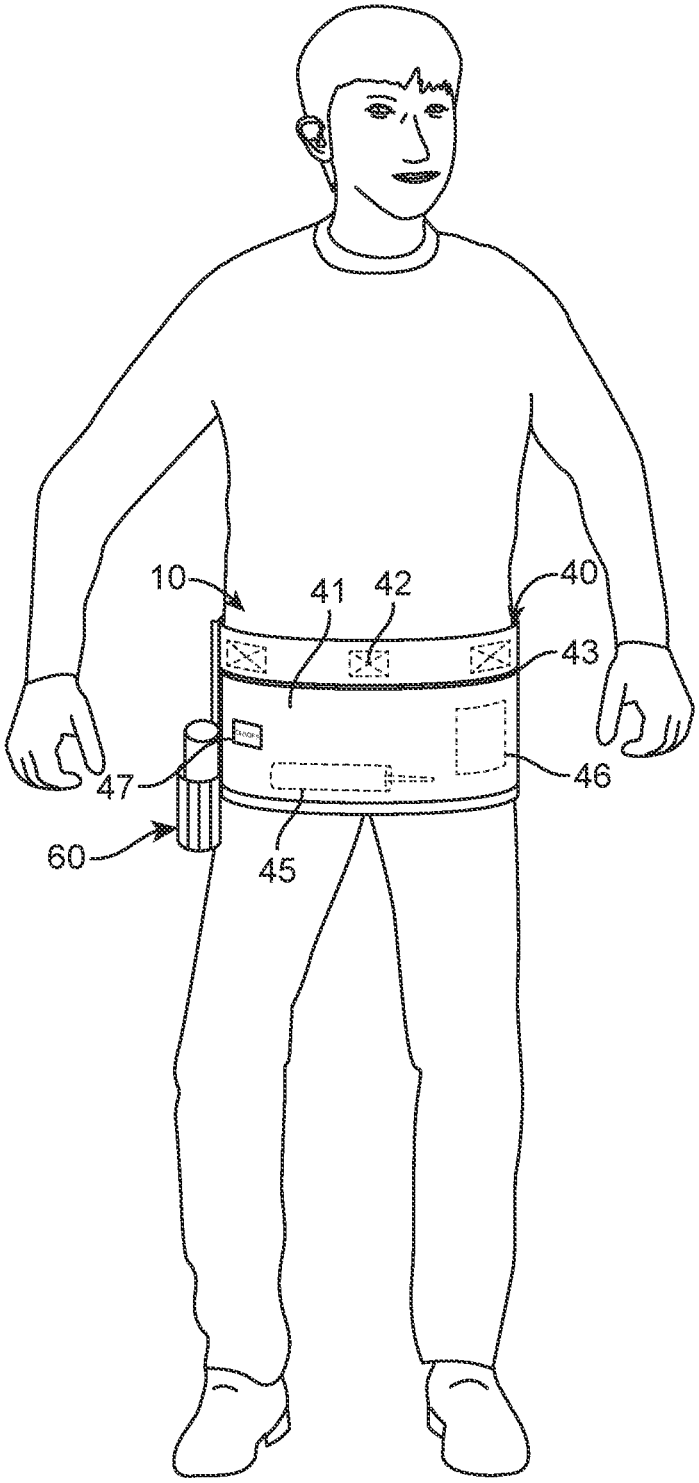
FIG. 1 represents an operational view of the heated pocket assembly 40 located at the front of a user with a caulk tube 45 stored therein.

Referring now to the drawings, where the present invention is generally referred to with numeral 10, it can be observed that it basically includes a belt assembly 20, a heated pocket assembly 40, a rigid pocket assembly 60, a single pocket assembly 80, and a two-tier pocket assembly 90.

Figure 2:
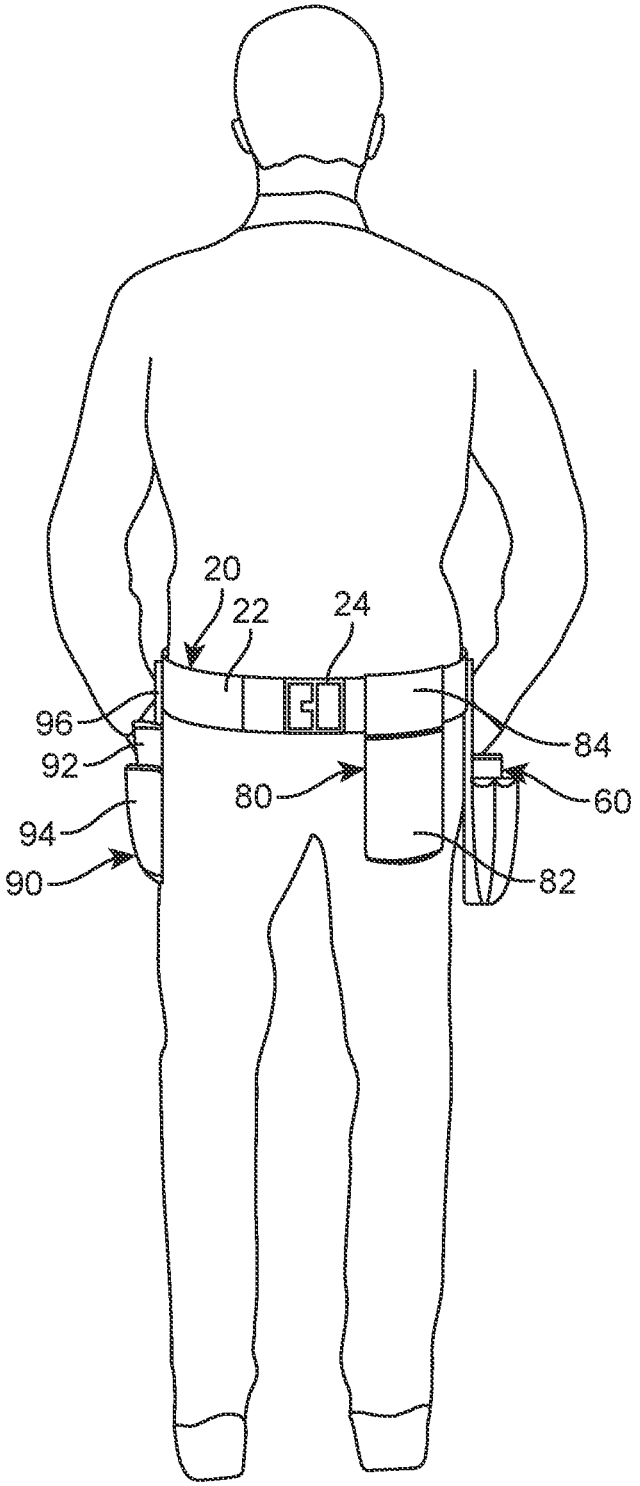
FIG. 2 shows an operational rear view of belt assembly 20 located at the rear of a user.

As best illustrated in FIG. 2, belt assembly 20 may include a belt 22 and a belt fastener 24. It may be preferable for belt 22 to be made of a leather or fabric material. The belt 20 may also be adapted to fit through the belt loops commonly found on most pants. Belt 22 may be adjustable to fit circumferentially about many users' waist. Securing the adjustment to a user may be a belt fastener 24. Belt fastener 24 may take the form of a buckle, hook and loop fastener, or a clasp. When belt 22 is fastened about a user via belt fastener 24 it may be suitable for the belt fastener 24 to be aligned and centered with the rear of a user.

Best depicted in FIG. 1 it may be preferable for heated pocket assembly 40 to be mounted to belt 22 at the front of a user via fastener 42. In one embodiment fastener 42 may be multiple stitched points attaching an upper interior portion of heated pocket 41 to belt 22. Heated pocket 41 may be a rectangular pouch with an upper flap serving as a pocket lid 48. The pocket lid 48 may include a pocket fastener 43 to maintain said pocket lid 48 in a closed configuration. Pocket fastener 43 may be located along the edge of the pocket lid 48. It may be suitable for pocket fastener 43 to take the form of a hook and loop fastener, zipper, or a magnet. The pocket fastener 43 may span the entire edge of pocket lid 48 that is in contact with a top edge of the body portion of the heated pocket 41. It may be suitable for the interior of heated pocket 41 to be insulated to help maintain a desired temperature therein. Internally mounted within heated pocket 41 may be an internal pocket 46. Internal pocket 46 may serve as a storage location for small items such as a mobile device, keys, or small tools. Internally lining the heated pocket 41 may also be a heating element 44.

Figure 4:
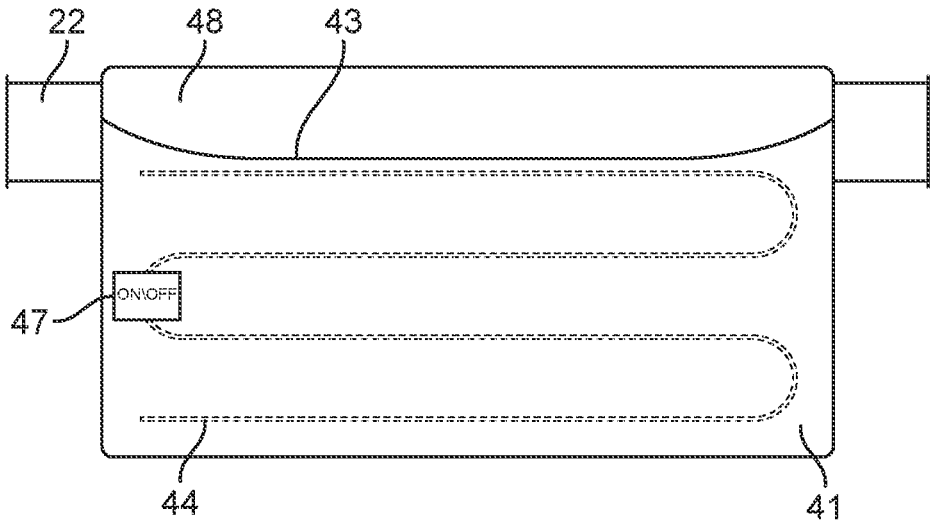
FIG. 4 is a representation of the distribution of the mounted heating element 44 within heated pocket assembly 40.
Figure 5:
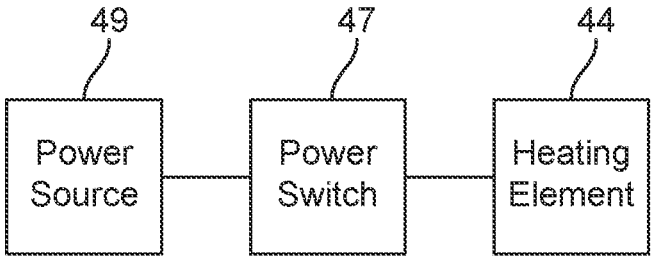
FIG. 5 depicts an electrical diagram for the powering of the heating element 44.

In one iteration, shown in FIG. 4, heating element 44 may take the form of an insulated wire or carbon fiber heating element spanning a heating pocket 41 wall that is opposite the wall in contact with a user. The placement of the heating element 44 on the opposite wall in contact with a user may allow for more heat to be transferred to the caulk tube 45 stored within rather than the user. It may be suitable for heating element 44 to be powered by power source 49. It may be preferable for power source 49 to be a rechargeable battery to allow for maximum mobility. Said rechargeable battery may be located within its own pouch mounted to belt 22. In one embodiment it may be suitable for heating element 44 to be turned on or off via a power switch 47. The power switch 47 may be mounted on a front exterior wall of heated pocket 41. It may be preferable for the heated pocket 41 to be made of a canvas, nylon, or other durable fabric material. It should be understood that the heated pocket assembly 40 may be used for the storage of silicone tubes as well as caulking tubes.

Figure 3:
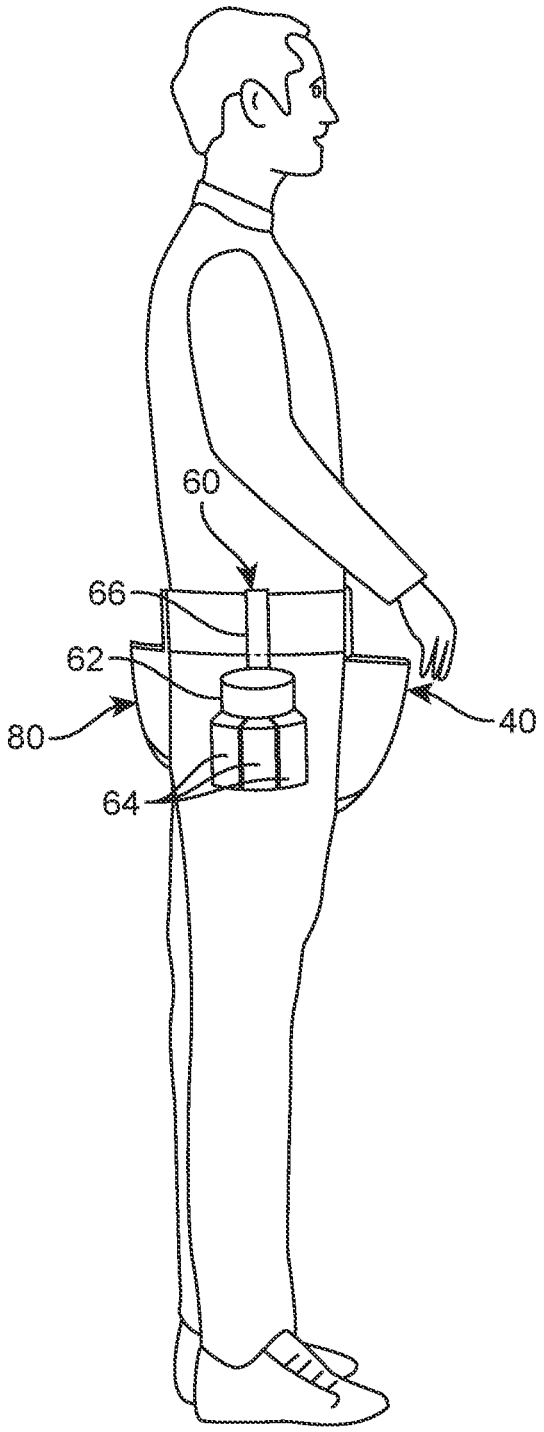
FIG. 3 illustrates an operational side view of rigid pocket assembly 60.

Referring now to FIGS. 2 and 3 it can be shown that the present invention 10 may include a rigid pocket assembly 60. Included in rigid pocket assembly 60 may also be a rigid pocket 62. In one embodiment rigid pocket 62 may be a hollow cylindrical container with an open top portion and a flat bottom portion. It may be preferable for rigid pocket 62 to be made of a plastic or other rigid waterproof material. Rigid pocket 62 may provide an accessible means to store containers with soap water as it is commonly used during caulking or silicone jobs. Rigid pocket 62 may be mounted to the belt 22 via a mounting loop 66. The mounting loop 66 may create a through hole by which the belt 22 can be received. Located circumferentially about the exterior of rigid pocket 62 may be at least one of the perimeter pockets 64. The bottom edge of perimeter pockets 64 may be flush to a bottom edge of rigid pocket 62. The top edge of perimeter pockets 64 may be located at a predetermined portion of a height of rigid pocket 62. The offset in height difference between the rigid pocket 62 and the perimeter pockets 64 may create tiers of pockets. Thereby allowing for greater user accessibility to tools stored in their respective pockets. It may be preferable for the perimeter pockets 64 to include a volume large enough to receive tooling sticks. Said tooling sticks help smooth and shape the caulking after it has been applied to a desired surface.

As best illustrated in FIGS. 2 and 3 mounted to belt 22 may also be single pocket assembly 80. Single pocket assembly 80 may include a single pocket 82 and a single pocket mounting loop 84. The single pocket 82 may be made of a canvas, nylon, or other durable fabric material. The single pocket mounting loop 84 may also create a through hole for the belt 22 to be received. The single pocket mounting loop 84 may allow the user to slide the single pocket 82 along the belt 22 where it may be of most convenience to said user.

As shown in FIG. 2 two tier pocket assembly 90 may include an upper tier pocket 92 and a lower tier pocket 94. The upper tier pocket 92 may be mounted to belt 22 via a two-tier pocket mounting loop 96. The two-tier pocket mounting loop 96 may create a through hole for the belt 22 to be received. The two-tier pocket mounting loop 96 may allow for slidable adjustments to be made to the position of two-tier pocket assembly 90 about belt 22. Mounted to the exterior of the upper tier pocket 92 may be a lower tier pocket 94. A top edge of lower tier pocket 94 may be downwardly offset with respect to a top edge of upper tier pocket 92. The downwardly offset top edges may allow for greater accessibility by a user to their tools stored therein.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a heated caulk tool belt, comprising:

a. a belt assembly including a belt with a belt fastener, wherein said belt includes a two-tier pocket assembly mounted thereon via a two-tier pocket mounting loop; and b. a heated pocket assembly includes a heated pocket mounted to said belt via a fastener, wherein said heated pocket includes an electrically powered heating element mounted therein, wherein said heated pocket is a rectangular pouch configured to store caulk tubes wherein said heated pocket includes a top portion fastened to said belt with stitches said heated pocket having a height greater than a height of said belt, said top portion extending a height of said belt, wherein said heated pocket includes a lid portion with a lid fastener mounted along the lid portion edge; and c. a rigid pocket assembly including a rigid pocket mounted to said belt via a mounting loop, wherein said rigid pocket includes perimeter pockets mounted about an exterior of the rigid pocket, said mounting loop entirely covering a portion of the belt, said mounting loop extending downwards from said belt, said rigid pocket having a predetermined separation with said belt, wherein said rigid pocket is opposite to said pocket assembly, said rigid pocket assembly mounted to a side of the belt opposite to said two-tier pocket assembly.

2. The system for a heated caulk tool belt of claim 1 wherein said belt includes a single pocket assembly mounted thereon via a single pocket mounting loop.

3. The system for a heated caulk tool belt of claim 1 wherein said belt fastener is a belt buckle.

4. The system for a heated caulk tool belt of claim 1 wherein said lid fastener is a zipper.

5. The system for a heated caulk tool belt of claim 1 wherein said lid fastener is a hook and loop fastener.

6. The system for a heated caulk tool belt of claim 1 wherein said rigid pocket is cylindrical and waterproof, said rigid pocket is made of plastic.

7. The system for a heated caulk tool belt of claim 1 wherein said electrically powered heating element is an insulated wire lining the interior of the heated pocket.

8. The system for a heated caulk tool belt of claim 7 wherein said electrically powered heating element is powered by a rechargeable battery.

9. The system for a heated caulk tool belt of claim 1 wherein said heated pocket includes an interior pocket mounted therein.

10. A system for a heated caulk tool belt, consisting of:

a. a belt assembly including a belt with a belt buckle; and b. a single pocket assembly mounted on said belt via a single pocket mounting loop, said single pocket mounting loop entirely covering a portion of said belt; and c. a two-tier pocket assembly mounted on said belt via a two-tier pocket mounting loop, wherein said two-tier pocket includes two pockets with their respective top edges downwardly offset; and d. a heated pocket assembly includes a heated pocket mounted to a front portion of said belt opposite to said belt buckle via a fastener in the form of stitches, said heated pocket being a rectangular pouch with an upper flap serving as a pocket lid said heated pocket is configured to store caulk tubes, the pocket lid includes a lid fastener mounted along the lid portion edge, the lid fastener being a hook and loop fastener, said heated pocket includes an electrically powered heating element mounted therein, wherein said electrically powered heating element is an insulated wire lining an interior of the heated pocket located on a heated pocket wall that is opposite to a user, the electrically powered heating element being powered by a rechargeable battery, said rechargeable battery being within a pouch mounted to belt, the heated pocket includes an interior pocket mounted therein, said heated pocket includes a power button mounted to an exterior to turn on and turn off the electrically powered heating element; and e. a rigid pocket assembly including a rigid pocket mounted to said belt via a mounting loop, said mounting loop entirely covering a portion of the belt, said mounting loop extending downwards from said belt said rigid pocket having a predetermined separation with said belt, wherein said rigid pocket is opposite to said pocket assembly, said rigid pocket being cylindrical with an open top portion, the rigid pocket is made of a rigid waterproof plastic, wherein said rigid pocket includes three perimeter pockets mounted about an exterior of the rigid pocket, said three perimeter pockets having a top edge that is entirely below a rigid pocket top edge.

* * * * *